US005162702A

United States Patent [19]

Schmees et al.

[11] Patent Number: 5,162,702

[45] Date of Patent: Nov. 10, 1992

[54] FLASHING LIGHT WARNING APPARATUS

[75] Inventors: Siegfried Schmees, Geseke; Werner Lepper, Erwitte; Wolfgang Grimm, Bremen; Heiko Janssen, Delmenhorst, all of Fed. Rep. of Germany

[73] Assignee: Hella KG Hueck & Company, Lippstadt, Fed. Rep. of Germany

[21] Appl. No.: 696,966

[22] Filed: May 8, 1991

[30] Foreign Application Priority Data

May 14, 1990 [DE] Fed. Rep. of Germany ..... 4015401

[51] Int. Cl.[5] ..... H05B 37/00

[52] U.S. Cl. ..... 315/241 R; 315/200 R; 315/208

[58] Field of Search ..... 315/200, 208, 215, 225, 315/241 P, 241 R

[56] References Cited

U.S. PATENT DOCUMENTS

| | | | |
|---|---|---|---|
| 3,644,818 | 2/1972 | Paget | 321/2 |
| 3,666,964 | 5/1972 | Flynn | 315/241 P |
| 3,758,817 | 9/1973 | Elliott | 315/241 P |
| 4,687,971 | 8/1987 | Shimizu | 315/241 R |

FOREIGN PATENT DOCUMENTS 2420197 11/1977 Fed. Rep. of Germany .

*Primary Examiner*—Eugene R. LaRoche
*Assistant Examiner*—R. A. Ratliff
*Attorney, Agent, or Firm*—Griffin, Butler, Whisenhunt & Kurtossy

[57] ABSTRACT

In flashing light warning apparatus of a type having a voltage source (U), a main blocking transformer (HW), a flash tube (R), an ignition device (Z), a first and a third storage condenser (K1, K3), and an electrical switching device (S1), a switching path of the first electrical switching apparatus is arranged parallel to the first storage condenser, the third storage condenser and the ignition device are coupled to an auxiliary blocking transformer (ZW), and the first switching device can be switched by a control device (B). Such a flashing light warning apparatus can be produced in an uncomplicated, cost effective manner, to provide light energy which can be changed during operation to provide a day flash and at least one type of night flash. The night flash is at such a level that its output can be recognized from afar only by night vision apparatus.

8 Claims, 2 Drawing Sheets

FLASHING LIGHT WARNING APPARATUS

BACKGROUND OF THE INVENTION

This invention concerns a flashing light warning apparatus of a type having a voltage source, a main blocking, or isolating, transformer, a flash tube, an ignition device, two storage condensers, and an electrical switching apparatus.

Such a flashing light warning apparatus is described in U.S. Pat. No. 3,644,818 to Paget as having a voltage source, a main blocking (or gate, or isolation) transformer, a flash tube, an ignition device (or circuit) two storage condensers, and an electrical switching device. The electrical switching device is, in that case, arranged in series with one of the two storage condensers. When the electrical switching device is closed, both of the storage condensers are charged, or energized, to the same storage voltage. When the electrical switching device is open, the first storage condenser is charged somewhat more slowly than the second storage condenser through a resistor. By this means, the electrical energy provided to the flash tube, and thereby the light flash energy, should be influenced in dependence upon a switched position of the switching device such that with an open switching device a reduced light energy is released by the flash tube.

A disadvantage of the known light flash warning apparatus is, however, that it cannot produce light flashes with such reduced light energy that they do not disturb operation of, for example, airplanes utilizing night vision devices, because, despite the resistor which should effect a slower charging of the first condenser, this one, along with the second condenser, will be charged and upon ignition of the flash tube will be discharged. Light flashes produced in this manner display a light energy which lead to a blinding of a pilot employing night vision apparatus, also known as night vision goggles (NVG), with a surer operation not being possible.

This invention has the purpose of providing a flashing light warning apparatus which can be produced in an uncomplicated and cost effective manner and which, while dependably producing light flashes, makes possible a changing of light energy between a day flash and at least one night flash, in which the night flash achieves a light level which from afar is only recognizable with night vision apparatus.

SUMMARY OF THE INVENTION

According to principles of this invention, a flashing light warning apparatus of the type of this invention includes a switching path of a first electrical switching device arranged parallel to a first storage condenser, a third storage condenser and an ignition device coupled to an auxiliary blocking, gate, or isolating, transformer, and a control device for changing or controlling the first switching device.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF A PREFERRED EMBODIMENT

Figure 1:
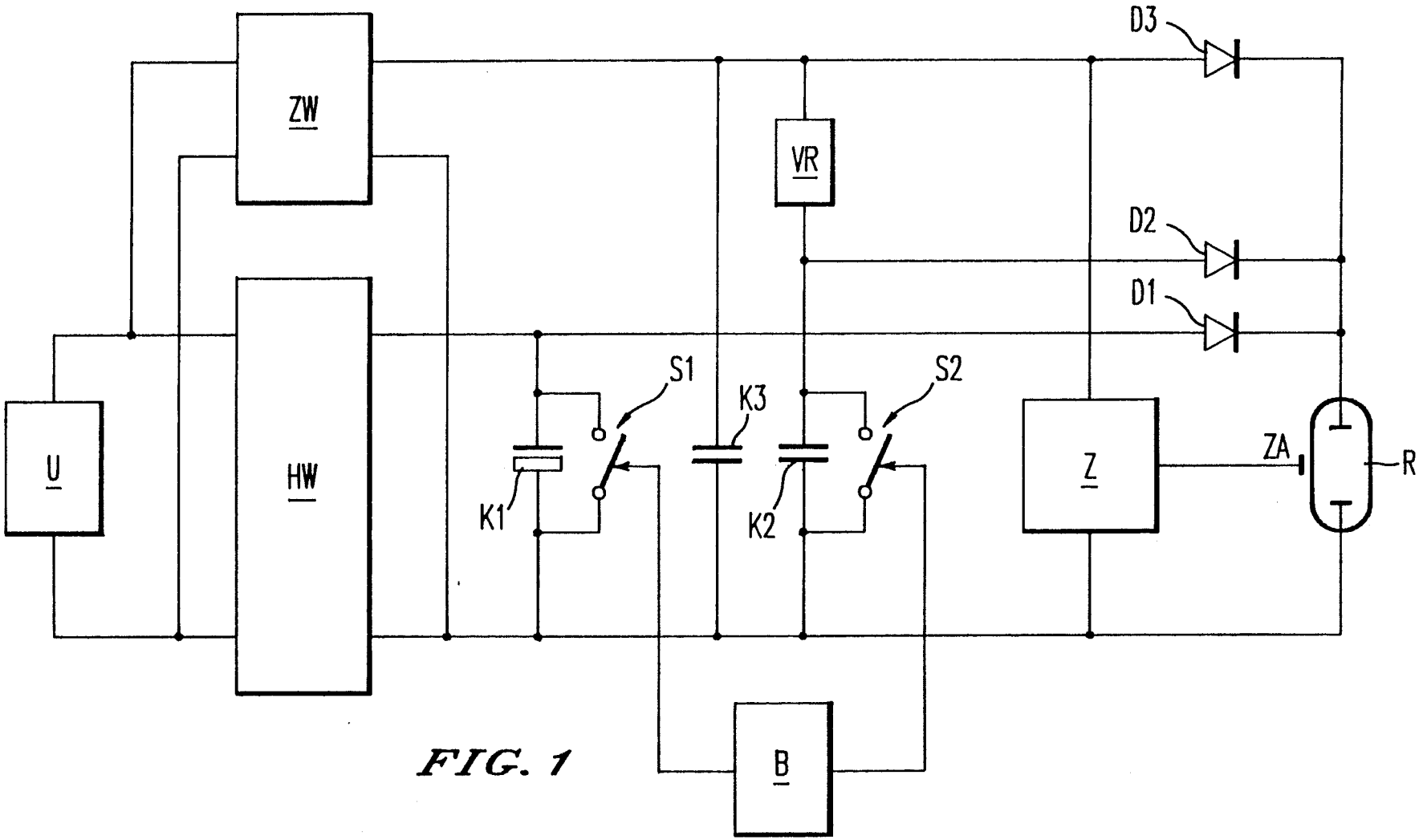
FIG. 1 is a partially-block/partially-schematic diagram of one embodiment of a flashing light warning apparatus of this invention.

FIG. 1 shows in a substantially block diagram form a representative example of a flashing light warning apparatus of this invention.

A main blocking, or isolating, or gate, transformer HW is shown here coupled to a voltage source U, which delivers a steady, or direct, or a changing voltage. The main blocking transformer HW produces from the voltage of the voltage source U a substantially steady, or direct, voltage which is sufficient to charge a first storage condenser, or capacitor, K1 arranged in parallel to outputs of the main blocking transformer HW with a storage energy sufficient to drive a flash tube R, connected in parallel to the first storage condenser K1, for creating sufficient light energy to be recognized during daylight or daytime. A first switching device S1 is arranged in parallel to the first storage condenser K1, which here for example can be an electrolytic condenser, and can be changed, or switched, by a control device B. With an open first switching device S1, the flash tube R will be fed an unlimited stored energy from the first storage condenser K1, With a closed first switching device S1, the first storage condenser K1, and thereby the short-circuit-resistant (designed to withstand short circuits) main blocking transformer HW are short circuited so that the stored energy of the first storage condenser K1 is not provided to the flash tube R for production of light flashes.

So that with a closed first switching device S1 the ignition device Z is fed a voltage from which the ignition device Z can produce high frequency ignition signals, the ignition device, or circuit, Z is electrically connected to an auxiliary blocking transformer ZW, which is coupled to the voltage source U. In another embodiment, the auxiliary blocking transformer ZW forms a part of the main blocking transformer HW.

To produce light flashes which do not disturb operation of airplanes, those, for example, employing night vision apparatus, a third storage condenser K3 is electrically coupled with the auxiliary blocking transformer and the flash tube R.

For production of a further light flash energy level, a second storage condenser K2 is electrically coupled via a series resistor VR firstly to the auxiliary blocking transformer ZW and secondly to the flash tube R. A second switching device S2 is arranged parallel to the second storage condenser K2, which second switching device is controlled, or switched, by the control device B so that the stored energy of the second storage condenser K2, depending upon the switching position of the second switching device S2, can be added to the stored energy of the first storage condenser K1 and/or the third storage condenser K3. The first storage condenser K1 is coupled to an anode of the flash tube R via a diode D1 which is conductive toward the flash tube, the second storage condenser K2 is coupled to the anode of the flash tube over a second diode D2, which conducts in the direction of the flash tube R, and the third storage condenser K3 is coupled with the flash tube R over a third diode D3, also conducting toward the flash tube. The diodes D1, D2 and D3 serve to decouple, or isolate, and make certain that, depending upon the switching conditions of the first and second switching devices S1, S2, the stored voltage is made available to the flash tube R without reduction or limitation.

The series resistor VR for the second storage condenser K2 is arranged so that, for one thing, when the switching device S2 is closed the stored energy of the third condenser K3 does not flow over the second switching device but rather is made available to the flash tube R—that is, it is designed to have a sufficiently high resistance for this purpose—, but it also is arranged to have a sufficiently low resistance such that the second storage condenser K2 is reliably and completely charged upon operation of the flashing light warning apparatus.

The ignition device, or circuit, Z can include a cyclical, or pulse, generator or can be coupled with such a generator in order to produce periodic high frequency ignition signals. The ignition device Z shown in FIG. 1 is depicted, for example, as a parallel connected ignition circuit which produces high frequency ignition voltage over the ignition anode ZA of the flash tube R.

The control device B can be manually operated, however it can also operate automatically, dependent upon predetermined parameters, to switch, for example, the first switching device S1 and/or the second switching device S2 upon automatic recognition of a night flight operation.

The switching devices S1, S2 can be transistors, thyristors or similar switching devices.

Operation of the embodiment of FIG. 1 is described in more detail below with the use of an example.

In this regard, the following modes of operation should be distinguished:

Daytime operation, switching device S1 open, switching device S2 open:

in this mode of operation, the flash tube R receives the full energy stored on the storage condensers K1, K2 and K3 so that periodic light flashes can be produced under control of the ignition circuit Z which are recognizable without help, or by naked eye, in daytime or daylight.

This is also true when the switching device S1 is open and the switching device S2 is closed so that the light energy is only reduced by an amount of stored energy provided by the second storage condenser K2. For example, if the stored energy of the first storage condenser is around 100 Ws watt-seconds, or joules, and the stored energies of the second storage condenser K2 and the third storage condenser K3 are, for example, in a range of around 100 mWs (milliwatt seconds or millijoules), a switching, or closing, of the second switching device S2, when the first switching device S1 is open can be disregarded. Depending upon use, the given values for the storage energy of the condensers K1, K2, K3 can vary.

Nighttime operation, first switching device S1 closed, second switching device S1 open:

In this case, the first storage condenser K1 is short circuited so that only the stored energy of the second storage condenser K2 and of the third storage condenser K3 are made available to the flash tube R. If the stored energies of the second storage condenser K2 and the third storage condenser K3, for example, are around 60 mWs for one thing it is assured that the flash tube is dependably ignited and for another thing it guaranteed that in an operation in which, for example, an airplane utilizes night vision apparatus, light flashes will be produced which do not lead to the blinding of a pilot and which cannot be seen from afar by the naked eye.

Night operation, first switching device S1 closed, second switching device S2 closed:

In this case, the second storage condenser K2 is short circuited along with the first storage condenser K1 so that the flash tube R is only fed stored energy of the third storage condenser K3. The on and off switching of the second storage condenser can be quite beneficial depending upon prevailing light conditions.

Figure 3:
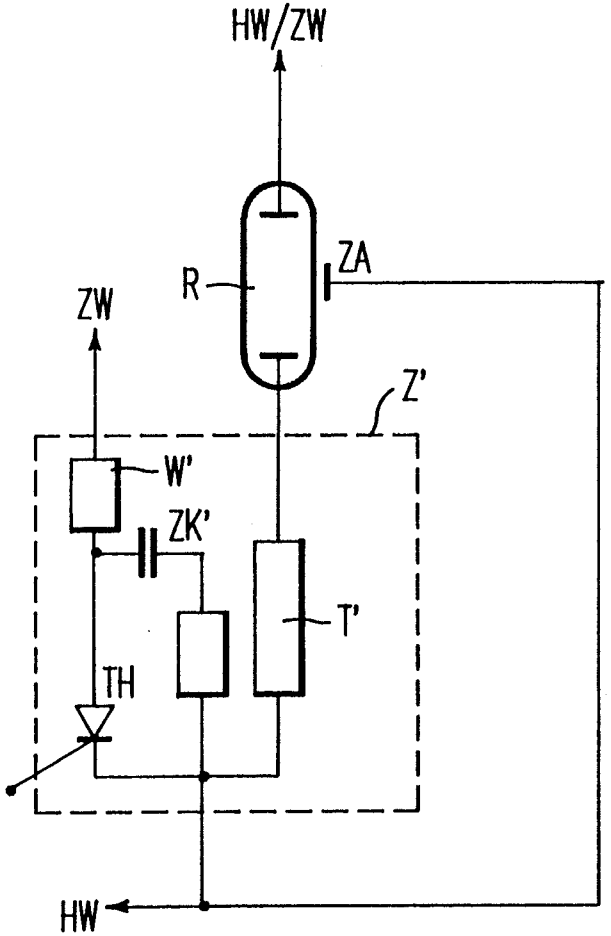
FIG. 3 is a serial ignition circuit of a type which can be used in a circuit similar to that of FIG. 1.
Figure 2:
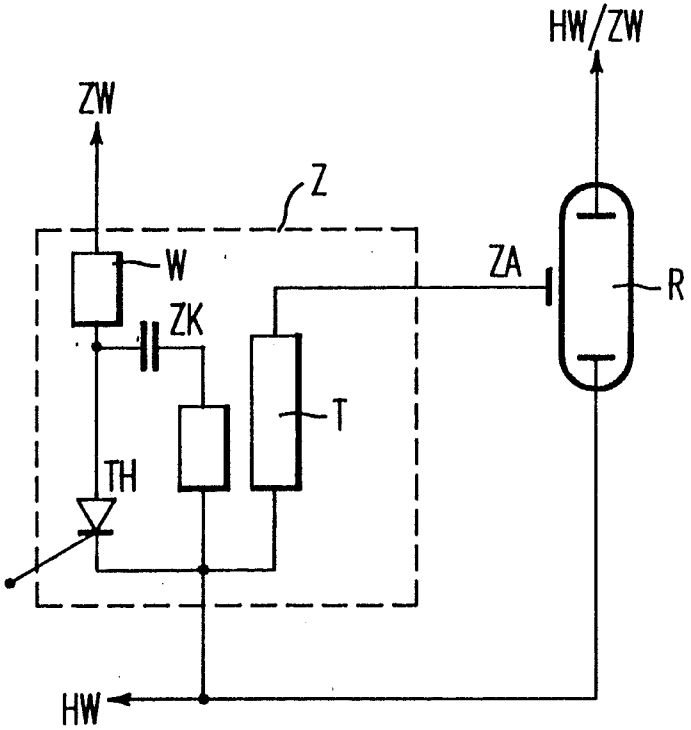
FIG. 2 is a parallel ignition circuit of a type which can be used in the circuit of FIG. 1.

FIG. 2 shows a representative embodiment of a parallel ignition device or circuit Z and FIG. 3 shows a representative embodiment of a series ignition device Z'. Each of the ignition devices Z and Z' respectively includes a resistor W and W' an ignition condenser ZK and ZK', a transformer T and T', and a switch TH and TH' (which switch here, for example is depicted as a thermistor and is controlled by a cyclical, or pulse, generator which is not shown here), to provide ignition energy of the ignition condenser ZK and ZK' over the transformer T and T to the flash tube R.

In the parallel ignition device Z of FIG. 2, the ignition voltage is fed to the ignition anode ZA of the flash tube R.

In the series connected ignition device of apparatus Z' of FIG. 3, the high frequency ignition energy is fed to the flash tube R over its cathode.

It is beneficial that the switching path of a first electrical switching device is arranged to be parallel to the first storage condenser because in this manner when the switching path of the first switching device is open unrestricted stored energy in the first storage condenser can be provided to the flash tube and can thereby produce a stronger daylight flash recognizable without enhancement by a naked eye and, upon a closed first switching device, the first storage condenser is short circuited so that the stored energy of the first storage condenser is not made available to the flash tube.

Since a third storage condenser and the ignition device are coupled with an auxiliary blocking transformer when the first switching device is closed, it is assured for one thing that the ignition device is provided with a voltage which dependably produces high frequency ignition signals and for another thing that the third storage condenser is charged with a stored energy which ensures that the flash tube is ignited such that stored energy made available from the third storage condenser, and thereby light flash energy, is sufficiently small that it does not disturb operation of an airplane that is using night vision apparatus when the first storage condenser is short circuited.

In this regard, it is beneficial that the first switching device is switchable, or operatable, by a control device in such a manner that a particularly certain and reliable manual or automatic changing of the first switching device, and thereby a changing from daylight operation to nighttime operation, results. It is beneficial that the connection between the first storage condenser and the anode of the flash tube has a diode therein which conducts towards the flash tube because in this manner it is ensured that upon a short circuit of the first storage condenser an ignition by means of energy from the third storage condenser can result without flowing to the main blocking transformer HW.

Because the switching path of a second switching device is arranged parallel to a second storage condenser, because the second storage condenser is connected with the auxiliary blocking transformer, and because the second switching device is switched by the control device, the benefit results that, depending upon switching of the first switching device and the second switching device by the control device, a further light flash energy level for light flashes from the flash tube can be switched in. In this regard, it is beneficial that a coupling between the second storage condenser and the anode of the flash tube has a second diode arranged therein for conducting toward the flash tube so that when the second switching device is closed, stored energy of the third storage condenser can be discharged only through the flash tube.

It is beneficial that a high-resistance series resistor is arranged in the coupling between the second storage condenser and the third storage condenser because in this manner it is assured that when the second switching device is closed the stored energy of the third storage condenser cannot flow over the switching path of the second switching device but rather must be discharged through the flash tube. The series resistor is thereby so arranged that it is sufficiently small to allow the second storage condenser to be sufficiently quickly charged when the second switching device is open.

Because the connection between the third storage condenser and the anode of the flash tube has a third diode arranged therein to be conductive toward the flash tube, the main gate, or blocking, transformer is decoupled, or isolated, from the auxiliary transformer, which is particularly necessary if the voltage of the main blocking transformer is larger than the voltage of the auxiliary blocking transformer.

It is beneficial that the ignition device can be either a parallel or a series connected ignition device because in this manner, depending upon an application, a particularly certain and dependable ignition results.

Because the ignition device includes a cyclical generator, or is connected with a cyclical generator, a particularly reliable periodic, or periodically changeable, ignition of the flash tube results with a particularly uncomplicated and cost effective embodiment of this invention.

While the invention has been particularly shown and described with reference to a preferred embodiment, it will be understood by those skilled in the art that various changes in form and detail may be made therein without departing from the spirit and scope of the invention.

The embodiments of the invention in which an exclusive property or privilege are claimed or defined as follows:

1. In a flashing light warning apparatus of a type including a voltage source, a main transformer, a flash tube, an ignition device, a plurality of storage condensers and an electrical switching apparatus;

the improvement wherein a switching path of a first switching device of the switching apparatus is arranged to be parallel to a first storage condenser, another storage condenser and the ignition device are coupled to an auxiliary transformer and the first switching device can be switched by a control device for discharging said first storage condenser thereby making possible the ignition and discharge of the flash tube with a smaller flash energy.

2. In a flashing light warning apparatus according to claim 1 wherein a coupling between the first storage condenser and an anode of the flash tube includes a diode arranged to conduct toward the anode.

3. In a flashing light warning apparatus according to claim 2 wherein is further included a second storage condenser and a second switching device whose switching path is parallel to the second storage condenser, wherein the second storage condenser is coupled to the auxiliary transformer, and wherein the second switching device is switched by the control device.

4. In a flashing light warning apparatus according to claim 3 wherein a coupling between the second storage condenser and the anode of the flash tube includes a second diode conducting toward the flash tube.

5. In a flashing light warning apparatus according to claim 4 wherein a resistor having a high resistance is arranged in a coupling between the second storage condenser and said another storage condenser.

6. In a flashing light warning apparatus according to claim 5 wherein a third diode is arranged in a coupling between the said another storage condenser and the anode of the flash tube to conduct in the direction of the flash tube.

7. In a flashing light warning apparatus according to claim 6 wherein the ignition device is arranged either in parallel or in series with the flash tube.

8. In a flashing light warning apparatus according to claim 7, wherein the ignition device includes or is coupled to a cyclical generator.

* * * * *